US011211037B2

(12) United States Patent
Takahashi et al.

(10) Patent No.: US 11,211,037 B2
(45) Date of Patent: Dec. 28, 2021

(54) KEYBOARD APPARATUS

(71) Applicant: YAMAHA CORPORATION, Hamamatsu (JP)

(72) Inventors: Ken Takahashi, Yokohama (JP); Kento Ogawa, Funabashi (JP); Hirotsugu Suzuki, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/016,957

(22) Filed: Sep. 10, 2020

(65) Prior Publication Data

US 2020/0410965 A1 Dec. 31, 2020

Related U.S. Application Data

(63) Continuation of application No. PCT/JP2018/012076, filed on Mar. 26, 2018.

(51) Int. Cl.
*G10C 3/18* (2006.01)
*G10C 3/12* (2006.01)

(52) U.S. Cl.
CPC ..... *G10C 3/18* (2013.01); *G10C 3/12* (2013.01)

(58) Field of Classification Search
CPC ..... G10C 3/18; G10C 3/12; G10D 3/00
See application file for complete search history.

(56) References Cited

U.S. PATENT DOCUMENTS

| | | | | |
|---|---|---|---|---|
| 3,724,317 | A * | 4/1973 | Rogers | G10C 3/28 84/447 |
| 6,118,063 | A | 9/2000 | Steinbuhler | |
| 2002/0073825 | A1 | 6/2002 | Chono | |

FOREIGN PATENT DOCUMENTS

| | | | |
|---|---|---|---|
| JP | S111596 | Y1 | 2/1936 |
| JP | S3814628 | Y1 | 7/1963 |
| JP | S4857024 | U | 7/1973 |
| JP | S57175195 | U | 11/1982 |
| JP | 2005208244 | A | 8/2005 |

(Continued)

OTHER PUBLICATIONS

International Search Report issued in Inti. Appln. No PCT/JP2018/012076 dated May 22, 2018 English translation provided.

(Continued)

*Primary Examiner* — Kimberly R Lockett
(74) *Attorney, Agent, or Firm* — Rossi, Kimms & McDowell LLP

(57) ABSTRACT

A keyboard apparatus includes a first key assembly, a second key assembly, and a third key assembly. The first key assembly includes a first key being slidably in contact with a first member at a first position and a second member at a second position. A first minimum distance between the first key assembly and the second key assembly at the rear ends thereof is larger than a second minimum distance between the first key assembly and the second key assembly at the second position within a range of rotation of the first key assembly. A third minimum distance between the first key assembly and the third key assembly at the rear ends thereof being larger than a fourth minimum distance between the first key assembly and the third key assembly at the second position within the range of rotation of the first key assembly.

17 Claims, 19 Drawing Sheets

(56) References Cited

FOREIGN PATENT DOCUMENTS

JP 2009025344 A 2/2009

OTHER PUBLICATIONS

Written Opinion issued in Intl. Appln. No. PCT/JP2018/012076 dated May 22, 2018. English translation provided.
Office Action issued in Japanese Appln. No. 2020-510184 dated Aug. 17, 2021. English machine translation provided.

* cited by examiner

KEYBOARD APPARATUS

CROSS REFERENCES TO RELATED APPLICATIONS

This application is based upon and claims the benefit of priority from the prior International Application PCT/JP2018/012076, filed on Mar. 26, 2018, the entire contents of which are incorporated herein by reference.

FIELD

The present disclosure relates to a keyboard apparatus.

BACKGROUND

A Keyboard apparatus includes a plurality of keys arranged side by side. The key pressing operation rotates the key, moves the hammer through the action mechanism, and sounds by striking the string with the hammer. At this time, the operation of the key, the action mechanism, and the hammer provides a sense of touch (hereinafter referred to as a touch feeling) to the player's fingers through the key. Therefore, the accuracy of the arrangement of the plurality of keys affect not only the aesthetic appearance of the musical instrument, but also the sounds of keyboard apparatus and the touch feeling given to the player.

Japanese Utility-model Publication Laid-Open No. S57-175195 discloses a keyboard apparatus in which a protrusion is arranged on a surface where a keyboard and a key arm are opposed to each other, and a vertical bending of the keyboard is absorbed by a gap generated by the protrusion to eliminate the variations during mounting.

SUMMARY

A keyboard apparatus according to an embodiment of the present disclosure includes a first key assembly including a first key arranged along a plane and rotatable about a first fulcrum, which is positioned between a rear end and a front end of the first key, and being slidably in contact with a first member along the plane at a first position of the first key and a second member along the plane at a second position, which is positioned on a rear side of the first position, of the first key, a second key assembly including a second key arranged next to the first key along the plane and rotatable about a second fulcrum positioned between a rear end and a front end of the second key, and being slidably in contact with a third member along the plane at a third position of the second key and a fourth member along the plane at a fourth position, which is positioned at a rear side of the third position, of the second key, wherein a first minimum distance between the first key assembly and the second key assembly at the rear ends thereof being larger than a second minimum distance between the first key assembly and the second key assembly at the second position within a range of rotation of the first key assembly, and a third key assembly including a third key arranged next to the first key along the plane on a side opposite to the second key and rotatable about a third fulcrum positioned between a rear end and a front end of the third key, and being slidably in contact with a fifth member along the plane at a fifth position of the third key and a sixth member along the plane at a sixth position, which is positioned at a rear side of the fifth position, of the third key, wherein a third minimum distance between the first key assembly and the third key assembly at the rear ends thereof being larger than a fourth minimum distance between the first key assembly and the third key assembly at the second position within the range of rotation of the first key assembly.

A keyboard apparatus according to an embodiment of the present disclosure includes a key assembly rotatably arranged along a first plane, the first key assembly being slidably in contact with another member along the first plane at a first position and at a second position on a rear end side of the first position, the first key assembly having a capstan in a rear end side with respect to the second position, a key width at a rear end is smaller than a key width at the capstan.

DETAILED DESCRIPTION

Figure 1:
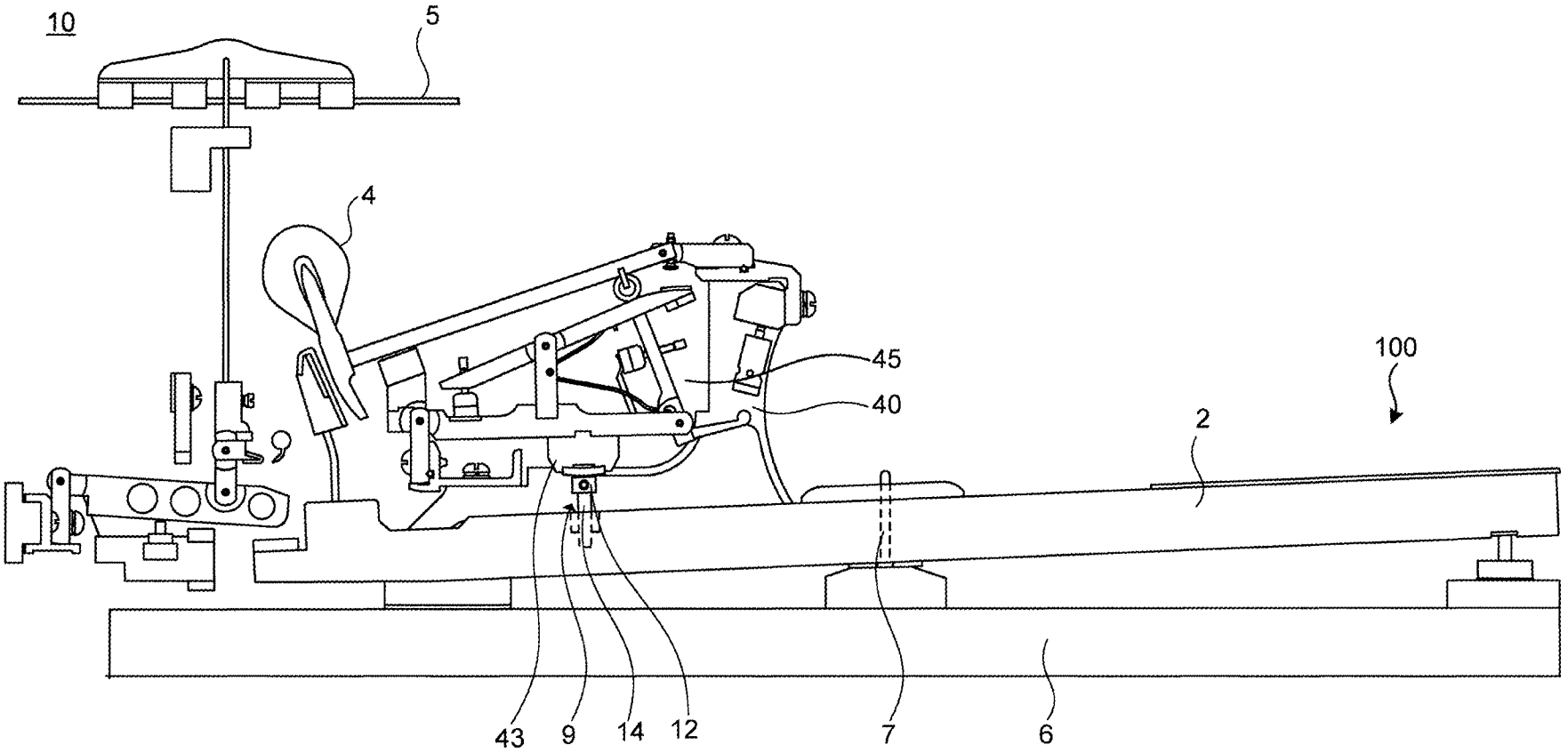
FIG. 1 is a diagram showing a keyboard assembly of a keyboard apparatus in one embodiment of the present disclosure.

Hereinafter, a keyboard apparatus according to embodiments of the present disclosure will be described in detail by referring to the drawings. The following embodiments are examples of the embodiments of the present disclosure, and the present disclosure is not construed as being limited to these embodiments. In the drawings referred to in the present embodiment, the same portions or portions having similar functions are denoted by the same reference numerals or similar reference numerals (only A, B, etc. are denoted after numerals), and a repetitive description thereof may be omitted. For convenience of description, the dimensional ratio of the drawings (the ratio between the components, the ratio in the vertical and horizontal directions, etc.) may be different from the actual ratio, or a part of the configuration may be omitted from the drawings.

The directions (the rotation direction R and the yawing direction Y) used in the following description will be defined. The rotation direction R corresponds to the direction in which key 2 is rotated about a direction in which it extends (a direction from the front to the back as viewed from the player). The yawing direction Y is a direction in which the key 2 bends in the left-right direction when viewed from above. The movement of key 2 in the yawing direction Y corresponds to bending (warping) in the scale direction S.

In a keyboard instrument such as a grand piano, a key is generally rotatably supported on a key bed at the substantially central portion in the longitudinal direction of the key. In order to suppress lateral movement and twisting of the key due to the key pressing operation during performance, the key guides are arranged which restricts the movement of the key within a predetermined range and slidably in contact with the key. However, there are no restrictions in the lateral direction of the key in the rear end side of the key guide. For example, when the key bends toward the scale direction due to environmental changes, aging changes, etc., the adjacent keys will interfere with each other, greatly affecting the sounds of keyboard apparatus's and the performer. The same problem arises with an electronic piano or the like having a corresponding configuration. However, in Japanese Utility-model Publication Laid-Open No. S57-175195, no considerations have been made regarding the variations in the horizontal direction of the key. One of the objects of the present disclosure is to improve the reliability of a keyboard apparatus by suppressing the effects of environmental changes and aging changes of the key, and the effects of lateral movement and twisting of the key due to the key pressing operation at the time of performance.

First Embodiment

[General Configuration of a Keyboard Apparatus]

In this embodiment, as an example of a keyboard apparatus, a grand piano having a keyboard on the front of which a plurality of keys to be performed by a player is arranged will be described. However, the keyboard apparatus is not limited to this, and may be any keyboard apparatus driven by a key assembly having a key to be described later.

The plurality of keys includes white keys and black keys. The plurality of white keys and the plurality of black keys are arranged side by side. The number of keys is N, which we assume to be 88. The direction in which a plurality of keys are arranged is referred to as a scale direction S. Here, the white keys and the black keys will be referred to as key 2 in the case of being described without making a distinction.

[Configuration of a Keyboard Assembly]

FIG. 1 is an enlarged view showing the vicinity of an action mechanism of the keyboard apparatus. In FIG. 1, the configuration arranged corresponding to each key 2 is shown with reference to the configuration arranged for one key 2 shown (in this example, the white key), and the configuration arranged for the other key 2 is omitted from the description.

In the descriptions of the present specification, the directions such as upward, downward, leftward, rightward, frontward, and rearward indicate the directions when the keyboard apparatus is viewed by the player during performance. In some cases, the directions may be indicated with respect to the key 2 as a reference, such as a front end side of the key (key front side) or a rear end side of the key (key rear side). In this case, the front end side of the key indicates the frontward of key 2 as viewed from the player. The rear end side of the key indicates the rearward of key 2 as viewed from the player.

As shown in FIG. 1, a keyboard assembly 10 is arranged in the keyboard apparatus. The Keyboard assembly 10 includes a key assembly 100 including key 2, an action mechanism 45, a hammer 4, and a key bed 6. The Key bed 6 is fixed at the bottom surface of the housing of the keyboard apparatus.

The Key bed 6 has a balance pin 7 (second member, fourth member, and sixth member) protruding in the direction substantially perpendicular to the key bed 6. The Key 2 has a first hole part 22 approximately at the center of the key 2 in the longitudinal direction. The inner surface of the first hole part 22 of the key 2 is slidably in contact with the balance pin 7 of the key bed 6 in the longitudinal direction of the key 2. The Balance pin 7 connects the key 2 to the key bed 6 so that the key 2 can rotate along the rotation surface (first plane). Further, the balance pin 7 is in contact with the inner surface of the first hole part 22 from the direction perpendicular to the rotation surface. As the balance pin 7 is in contacts with the inner surface of the first hole part 22 from a direction perpendicular to the rotation surface, the balance pin 7 determines the position of the key 2 in the scale direction S. That is, the rotating axis is arranged parallel to the scale direction S. The Balance pin 7 provides a fulcrum for supporting the key assembly 100 at the first hole part 22 of the key 2. Therefore, the key assembly 100 rotates around the balance pin 7 as a fulcrum by the key pressing operation of the key 2. Here, the key 2 may be composed of a plurality of members, or may be composed of various materials.

The Key bed 6 has a front pin 8 (first member, third member, and fifth member) protruding in the direction substantially perpendicular to the key bed 6. The Key 2 has a second hole part 24 that opens downward at the front end of the key 2. The inner surface of the second hole part 24 of the key 2 is slidably in contacts with the front pin 8 of the key bed 6 in substantially vertical direction. The Front pin 8 movably connects the front end of the key 2 along the rotational direction R. Further, the front pin 8 is in contact with the inner surface of the second hole part 24 from the direction perpendicular to the rotating surface. As the front pin 8 is in contacts with the inner surface of the second hole part 24 from a direction perpendicular to the rotation surface, the front pin 8 determines the position of the key 2 in the scale direction S. The Front pin 8 supports the key 2 so as to regulate the movement of the key assembly 100 in the scale direction S at the position of the second hole part 24 (the first position) of the key 2. In the present embodiment, the balance pin 7 also supports so as to restrict the movement of the key assembly 100 in the scale direction S at the position of the first hole part 22 (the second position) of the key 2. Here, the first position and the second position are defined as positions that restrict movement of the key assembly 100 in the scale direction S. It is preferable that two positions are arranged on one key 2 for restricting the key assembly 100 from moving in the scale direction S. By arranging the position where the key assembly 100 is restricted from moving in the scale direction S, lateral movement or twisting in the scale direction S due to the key pressing operation of the key assembly 100, bending due to environmental changes, aging changes, and the like can be suppressed. Here, a second position is defined as a position where the key assembly 100 is restricted from moving in the scale direction S on the most rear end side of the key 2, regardless of the fulcrum of the key 2. The configuration of the key 2 will be described in detail later.

The key assembly 100 has a capstan screw 9 on the rear end side of the fulcrum (a position supported by the balance pin 7) of the key 2. The capstan screw 9 has a head part 12 and a shaft part 14. The shaft part 14 of the capstan screw 9 is fastened to the top surface of the key 2, and the head part 12 of the capstan screw 9 is arranged above the key 2. That is, the head part 12 of the capstan screw 9 projects above the key 2. In the present embodiment, the capstan screw 9 is shown as a separate unite. However, the present disclosure is not limited thereto, and the key 2 and the capstan screw 9 may be integrated with each other.

On the top of the key assembly 100, the action mechanism 45 and the hammer 4 are arranged rotatably with respect to the frame 40. The action mechanism 45 and the hammer 4 are arranged corresponding to the key assembly 100. The support heel 43 arranged on the lower surface of the action mechanism 45 is slidably in contact with the upper surface of the capstan screw 9 of the key assembly 100. This sliding part, i.e. the part where the support heel 43 of the action mechanism 45 and the capstan screw 9 of the key assembly 100 contact, is arranged behind the fulcrum (a position supported by the balance pin 7) of the key 2 and above the key 2.

In the normal state (when the key is not pressed), the action mechanism 45 is placed above the capstan screw 9 of the key assembly 100, and the front end of the key 2 is pushed up. When the front end of the key 2 is depressed, the key assembly 100 rotates around the fulcrum, and the capstan screw 9 moves the hammer 4 upward via the action mechanism 45. As a result, the hammer 4 hits the string 5 arranged corresponding to the key assembly 100. The string 5 has a vibrational frequency corresponding to each key assembly 100 and emits sound by the impact of the hammer 4. When the key 2 is released, the key assembly 100 rotates around the fulcrum and returns to its original position, and moves the action mechanism 45 and the hammer 4 downwardly. The capstan screw 9 is defined as the position at which the action mechanism 45 is driven and the key 2 is loaded. Therefore, a component corresponding to the capstan screw 9 may be arranged on the action mechanism 45, and a component corresponding to the capstan screw 9 and the action mechanism 45 may be integrated with each other.

[Configuration of the Key Assembly]

Figure 2:
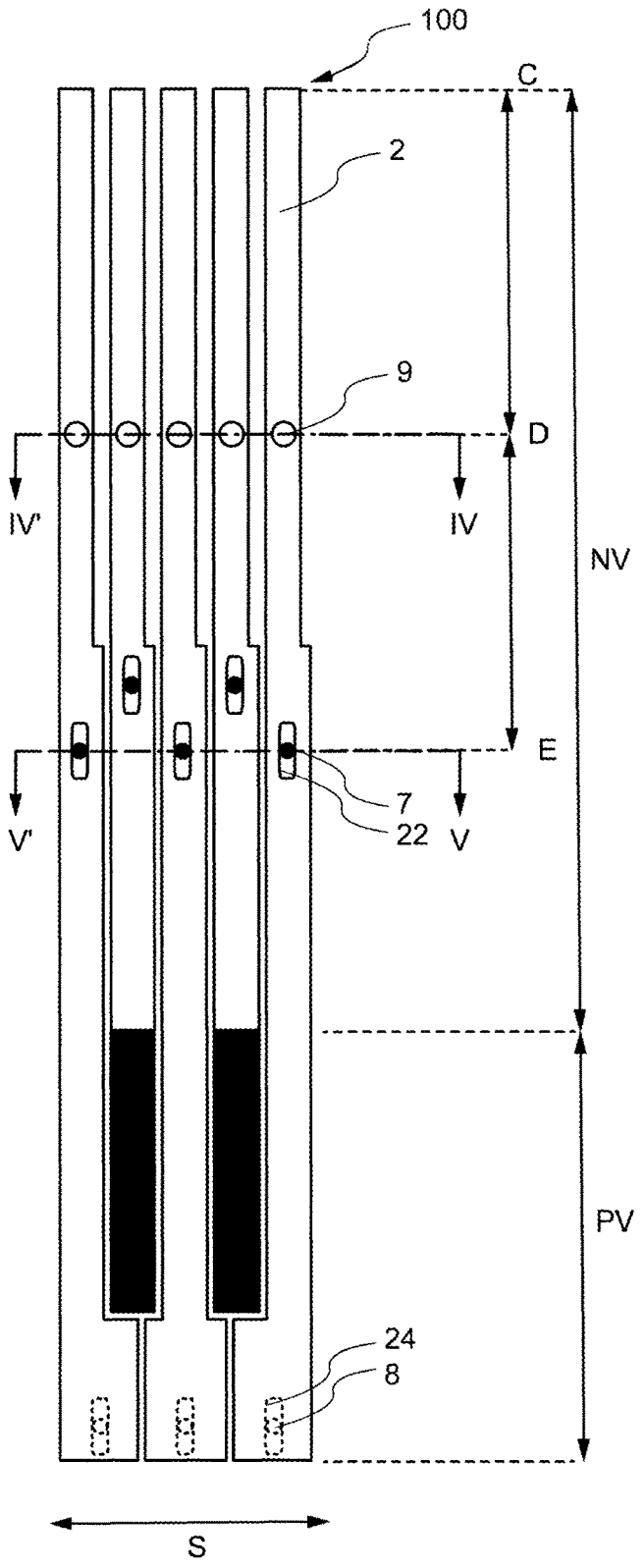
FIG. 2 is a top view showing a key assembly of a keyboard apparatus in one embodiment of the present disclosure.
Figure 3:
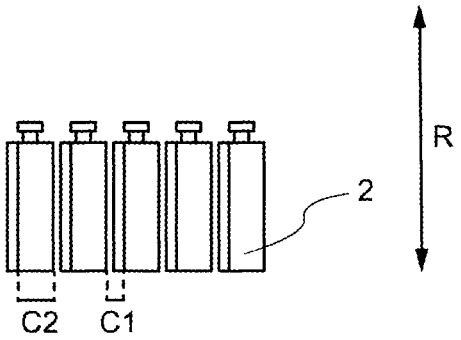
FIG. 3 is a rear view showing a key assembly of a keyboard apparatus in one embodiment of the present disclosure.
Figure 4:
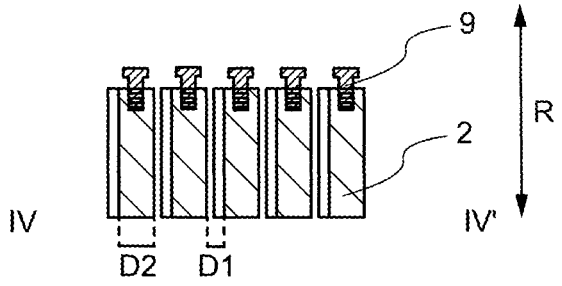
FIG. 4 is a cross-sectional view showing a key assembly of a keyboard apparatus in one embodiment of the present disclosure.
Figure 5:
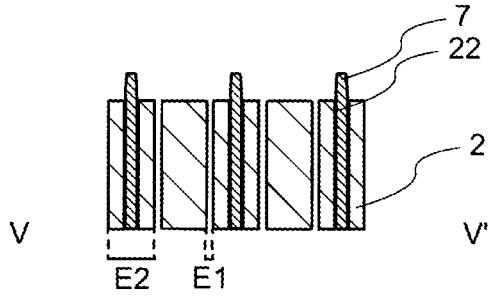
FIG. 5 is a cross-sectional view showing a key assembly of a keyboard apparatus in one embodiment of the present disclosure.

The configuration of the key assembly will be described in detail with reference to FIGS. 2 to 5. FIG. 2 is a top view showing the key assembly of the keyboard apparatus according to an embodiment of the present disclosure. FIG. 3 is a rear view showing the key assembly of the keyboard apparatus according to an embodiment of the present disclosure. FIG. 4 and FIG. 5 are a cross-sectional view showing the key assembly of the keyboard apparatus according to an embodiment of the present disclosure. FIG. 4 is IV-IV' cross-sectional view of FIG. 2 and FIG. 5 is V-V' cross-sectional view of FIG. 2.

When a keyboard apparatus is viewed from above, a part of the key assembly 100 resides inside a housing. When the key assembly 100 is viewed from above, a part of the key assembly 100 covered with the housing is referred to as a non-visible part NV, and a part exposed from the housing and visible to the player is referred to as an visible part PV. The visible part PV is a part of the key assembly 100, and indicates a region that can be played by a player. Hereinafter, a part of the key 2 exposed in the visible part PV may be referred to as a key main body part.

The key assembly 100 has the key 2 having the first hole part 22 and the second hole part 24, and the capstan screw 9. However, the present disclosure is not limited to this, and the key assembly 100 has a configuration in which the positional relation is fixed by the key 2 and rotates integrally by a key pressing operation. The inner surface of the first hole part 22 of the key 2 is slidably in contact with the balance pin 7. The inner surface of the second hole part 24 of the key 2 is slidably in contact with the front pin 8. The key assembly 100 is rotated around the position of the first hole part 22 (the second position). The Key assembly 100 is supported so as to restrict its movement in the scale direction S at the position of the second hole part 24 (the first position) and the position of the first hole part 22 (the second position) during rotation. Therefore, the rear end C of the key 2 moves along the rotation direction R when viewed from the rear end side of the key.

In the present embodiment, the minimum distance C1 of the rear end C is larger than the minimum distance E1 of the position E of the first hole part 22 (the second position) of the adjacent key assembly 100 in each rotation range. The minimum distance D1 of the position D of the capstan screw 9 is larger than the minimum distance E1 of the position E of the first hole part 22 (the second position) of the adjacent key assembly 100 in each rotation range. The minimum distance C1 of the rear end C is almost the same as the minimum distance D1 of the position D of the capstan screw 9 of the adjacent key assembly 100 in each rotation range. Here, as shown in FIGS. 2 and 5, when the position E of the first hole part 22 (the second position) differs depending on the plurality of key assembly 100, the minimum distance at the position E of the first hole part 22 (the second position) on the front end side (the front side as viewed from the player) of the key 2 is defined as D1.

The maximum width C2 of the rear end C is smaller than the maximum width E2 of the position E of the first hole part 22 (the second position) of the key assembly 100. The maximum width D2 of the position D of the capstan screw 9 is smaller than the maximum width E2 of the position E of the first hole part 22 (the second position) of the key assembly 100. The maximum width C2 of the rear end C is almost the same as the maximum width D2 of the position D of the capstan screw 9 of the key assembly 100. That is, the key widths of the key assembly 100 changes from the position E of first hole part 22 (the second position) toward the rear end. In the present embodiment, the key width of the key assembly 100 changes discontinuously between the position E of the first hole part 22 (the second position) and the position D of the capstan screw 9.

In this embodiment, the maximum width of the key assembly 100 at each location is the same as the maximum width of the key 2 at each location. However, the present disclosure is not limited to this, and when the key assembly 100 includes still another member, the maximum width of the key assembly 100 is the maximum width including the member which rotates integrally. In the present embodiment, the key 2 has almost the same vertical widths. However, the present disclosure is not limited to this, and the key 2 may have different widths in the vertical directions. The maximum width of the key assembly 100 is the maximum width in the vertical direction. In this case, the minimum distance at each position of each adjacent key assembly 100 in each rotation range indicates the distance between the maximum widths of the key assembly 100 at each position in the scale direction. For example, if a key assembly 100 with a wide bottom surface and a key assembly 100 with a wide top surface are alternately arranged, the minimum distance at each location of the adjacent key assembly 100 in each rotation range indicates the distance in scale from end portion of the wide bottom surface of the key assembly 100 to end portion of the wide top surface of the adjacent key assembly 100.

The central axis in the rear end C is misaligned from the central axis in the position E of the first hole part 22 (the second position) of the key assembly 100. The central axis at the position D of the capstan screw 9 is misaligned from the central axis at the position E of the first hole part 22 (the second position) of the key assembly 100. The central axis at the rear end C is almost consistent with the central axis at the position D of the capstan screw 9 of the key assembly 100. That is, the center of gravity of the key assembly 100 is shifted in the scale direction at the rear end C and the position D of the capstan screw 9, and at the position E of the first hole part 22 (the second position). Here, the central axis indicates the center in the scale direction with the longitudinal direction of the key assembly 100 as an axis when viewed from above the key assembly 100.

In the present embodiment, the key assembly 100 in the non-visible portion NV is straight. The axes of the key assembly 100 are parallel when the key assembly 100 is viewed from above. However, the present disclosure is not limited thereto, and for example, the axis of the key assembly 100 may be bent. The axis of the key assembly 100 in the visible part PV and the axis of the key assembly 100 at least in the region from the position D of the capstan screw 9 to the rear end C may be parallel.

As described above, according to the key assembly 100 of the present embodiment, since the minimum distance C1 of the rear end C is larger than the minimum distance E1 of the position E of the first hole part 22 (the second position) of the adjacent key assembly 100 in the respective rotation range, the effect of the adjacent key assembly 100 due to the environmental changes and aging changes and the effect of lateral movement or twisting of key due to the key pressing operation during performance can be suppressed. A rigidity of the key 2 can be maintained by reducing the maximum width of the rear end C and the position D of the capstan screw 9, without changing the maximum width E2 of the position E of the first hole part 22 (the second position) of the key assembly 100. Therefore, the keyboard apparatus according to the present embodiment can maintain reliability.

Second Embodiment

In the second embodiment, a key assembly 100*a* having a configuration different from that of key assembly 100 in the first embodiment will be described. The second embodiment is different from the first embodiment in that the minimum distance C1*a* of the rear end C is larger than the minimum distance D1*a* of the position D of the capstan screw 9*a* of the adjacent key assembly 100*a* in each rotation range. The portions that are the same as those in the first embodiment are given the same numbers as in the previous description, and a repetition of descriptions will be omitted.

[Configuration of the Key Assembly]

Figure 6:
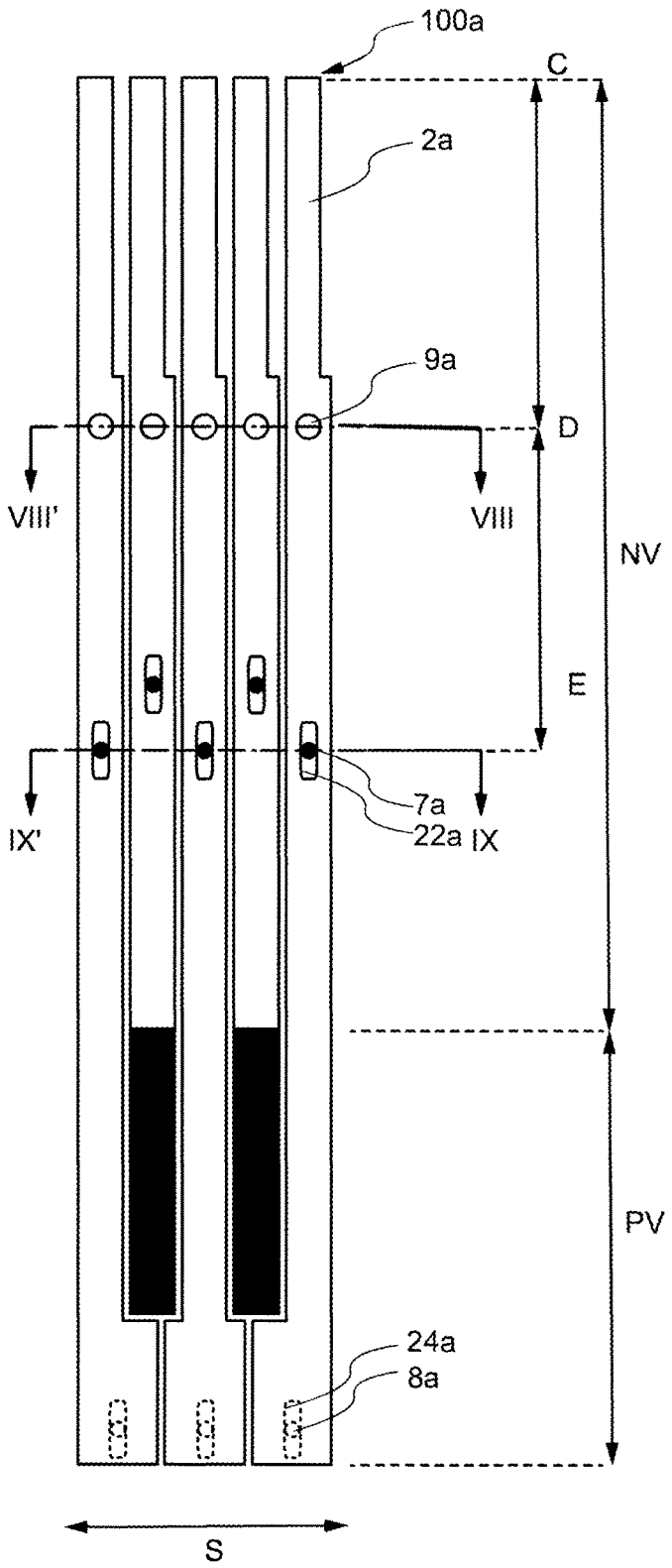
FIG. 6 is a top view showing a key assembly of a keyboard apparatus in one embodiment of the present disclosure.
Figure 7:
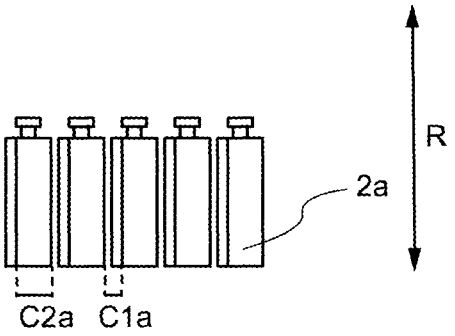
FIG. 7 is a rear view showing a key assembly of a keyboard apparatus in one embodiment of the present disclosure.
Figure 8:
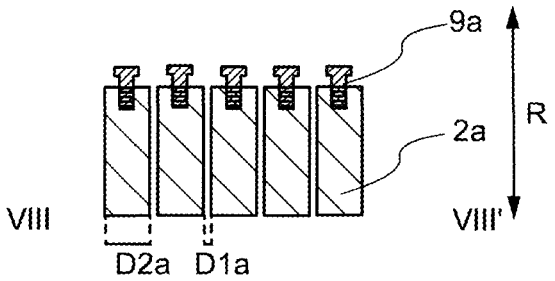
FIG. 8 is a cross-sectional view showing a key assembly of a keyboard apparatus in one embodiment of the present disclosure.
Figure 9:
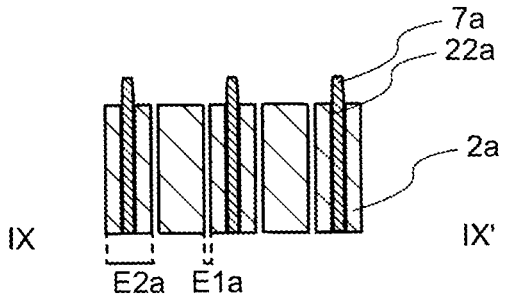
FIG. 9 is a cross-sectional view showing a key assembly of a keyboard apparatus in one embodiment of the present disclosure.

The configuration of the key assembly will be described in detail with reference to FIGS. 6 to 9. FIG. 6 is a top view showing the key assembly of the keyboard apparatus according to an embodiment of the present disclosure. FIG. 7 is a rear view showing the key assembly of the keyboard apparatus according to an embodiment of the present disclosure. FIG. 8 and FIG. 9 are a cross-sectional view showing the key assembly of the keyboard apparatus according to an embodiment of the present disclosure. FIG. 8 is VIII-VIII' cross-sectional view of FIG. 6 and FIG. 9 is IX-IX' cross-sectional view of FIG. 6.

In this embodiment, the minimum distance C1*a* of the rear end C is larger than the minimum distance E1*a* of the position E of the first hole part 22*a* (the second position) of the adjacent key assembly 100*a* in each rotation range. The minimum distance C1*a* of the rear end C is larger than the minimum distance D1*a* of the position D of the capstan screw 9*a* of the adjacent key assembly 100*a* in each rotation range. The minimum distance D1*a* of the position D of the capstan screw 9*a* is almost the same as the minimum distance E1*a* of the position E of the first hole part 22*a* (the second position) of the adjacent key assembly 100*a* in each rotation range.

The maximum width C2*a* of the rear end C is smaller than the maximum width E2*a* of the position E of the first hole part 22*a* (the second position) of the key assembly 100*a*. The maximum width C2*a* of the rear end C is smaller than the maximum width D2*a* of the position D of the capstan screw 9*a* of the key assembly 100*a*. The maximum width D2*a* of the position D of the capstan screw 9*a* is almost the same as the maximum width E2*a* of the position E of the first hole part 22*a* (the second position) of the key assembly 100*a*. In other words, the key widths of the key assembly 100*a* changes from the position D of the capstan screw 9*a* toward the rear end. In the present embodiment, the key width of the key assembly 100*a* changes discontinuously between the position D of the capstan screw 9*a* and the rear end C.

The central axis at the rear end C is misaligned from the central axis at the second position E of the first hole part 22*a* of the key assembly 100*a*. The central axis at the rear end C is misaligned from the central the axis at the position D of the capstan screw 9*a* of the key assembly 100*a*. The central axis at the position D of the capstan screw 9*a* almost coincides with the central axis at the position E of the first hole part 22*a* (the second position) of the key assembly 100*a*. That is, the center of gravity of the key assembly 100*a* is shifted in the scale directions between the rear end C, the position D of the capstan screw 9*a*, and the position E of the first hole part 22*a* (the second position).

As described above, according to the key assembly 100*a* of the present embodiment, since the minimum distance C1*a* of the rear end C is larger than the minimum distance D1*a* of the position D of the capstan screw 9*a* of the adjacent key assembly 100*a* in each rotation range, the effect of the adjacent key assembly 100*a* due to the environmental changes and aging and the effect of lateral movement or twisting of key due to the key pressing operation during performance can be suppressed. The rigidity of the key 2*a* can be maintained by reducing the maximum width C2*a* of the rear end C without changing the maximum width E2*a* of the position E of the first hole part 22*a* (the second position) and the maximum width D2*a* of the position D of the capstan screw 9*a* of the key assembly 100*a*. Therefore, the keyboard apparatus according to the present embodiment can maintain reliability.

Third Embodiment

In the third embodiment, a key assembly 100*b* having a configuration different from that of key assembly in the first embodiment and the second embodiment will be described. The third embodiment is different from the first and second embodiments in that the minimum distance C1*b* of the rear end C is larger than the minimum distance D1*b* of the position D of the capstan screw 9*b*, and the minimum distance D1*b* of the position D of the capstan screw 9*b* is larger than the minimum distance E1*b* of the position E of the first hole part 22*b* (the second position) of the adjacent key assembly 100*b* in each rotation range. The Parts that are the same as those of the first embodiment and the second embodiment are given the same numerals as those of the previous description, and a repetition of descriptions is omitted.

[Configuration of the Key Assembly]

Figure 10:
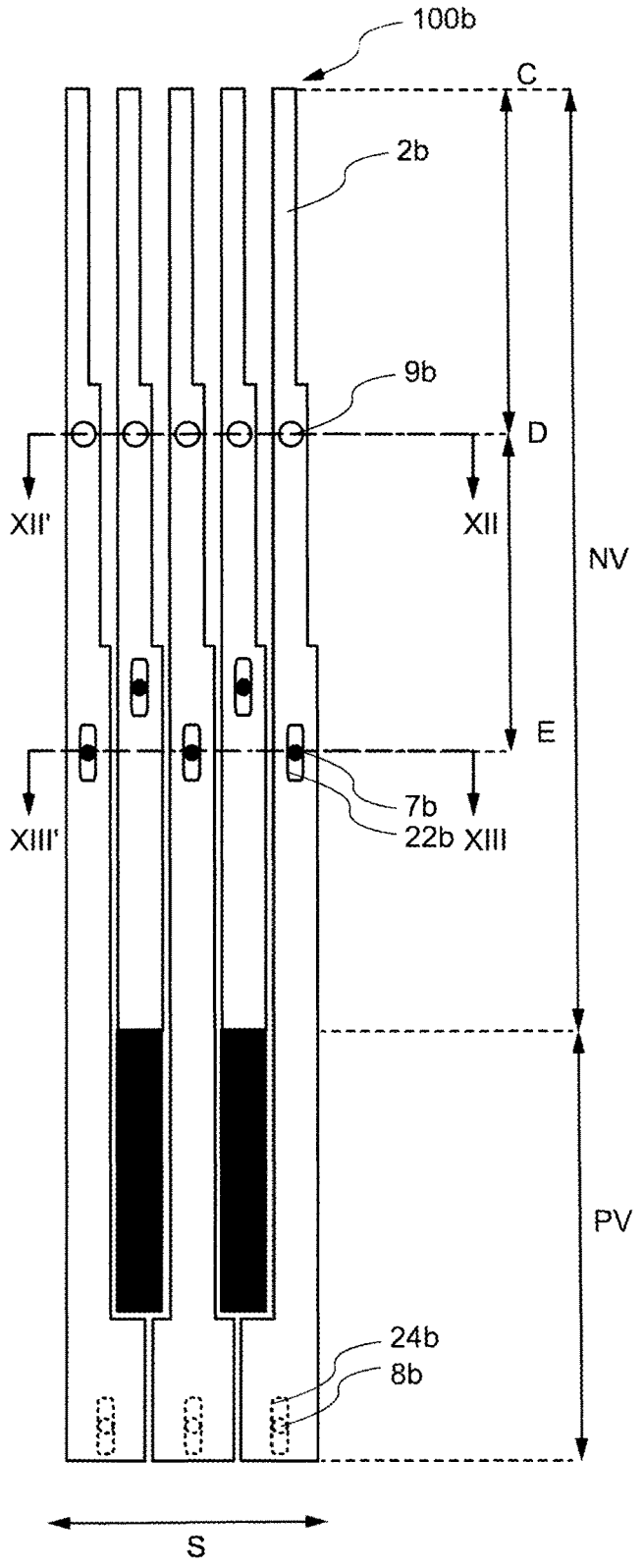
FIG. 10 is a top view showing a key assembly of a keyboard apparatus in one embodiment of the present disclosure.
Figure 11:
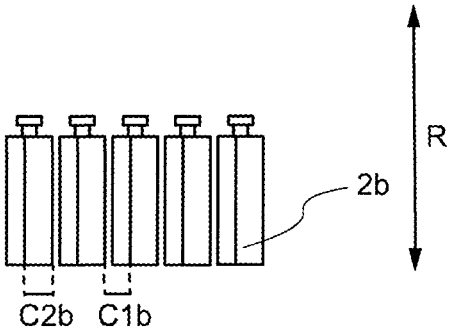
FIG. 11 is a rear view showing a key assembly of a keyboard apparatus in one embodiment of the present disclosure.
Figure 12:
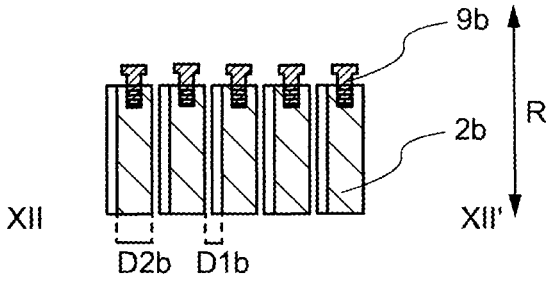
FIG. 12 is a cross-sectional view showing a key assembly of a keyboard apparatus in one embodiment of the present disclosure.
Figure 13:
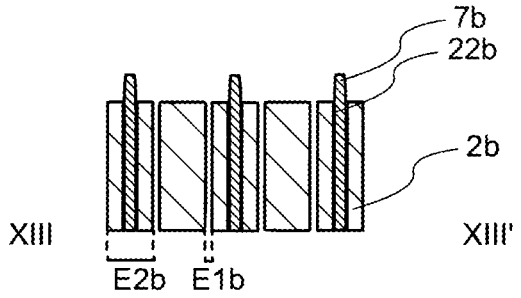
FIG. 13 is a cross-sectional view showing a key assembly of a keyboard apparatus in one embodiment of the present disclosure.

The configuration of the key assembly will be described in detail with reference to FIGS. 10 to 13. FIG. 10 is a top view showing the key assembly of the keyboard apparatus according to an embodiment of the present disclosure. FIG. 11 is the rear view of the key assembly of the keyboard apparatus according to an embodiment of the present disclosure. FIGS. 12 and 13 are a cross-sectional view showing the key assembly of the keyboard apparatus according to an embodiment of the present disclosure. FIG. 12 is XII-XII' cross-sectional view of FIG. 10 and FIG. 13 is XIII-XIII' cross-sectional view of FIG. 10.

In this embodiment, the minimum distance C1*b* of the rear end C is larger than the minimum distance D1*b* of the position D of the capstan screw 9*b* of the adjacent key assembly 100*b* in each rotation range. The minimum distance D1*b* of the position D of the capstan screw 9*b* is larger than the minimum distance E1*b* of the position E of the first hole part 22*b* (the second position) of the adjacent the key assembly 100*b* in each rotation range.

The maximum width C2*b* of the rear end C is smaller than the maximum width D2*b* of the position D of the capstan screw 9*b* of the key assembly 100*b*. The maximum width D2*b* of the position D of the capstan screw 9*b* is smaller than the maximum width E2*b* of the position E of the first hole part 22*b* (the second position) of the key assembly 100*b*. In other words, the key widths of the key assembly 100*b* changes from the position E of the first hole part 22*b* (the second position) toward the rear end, and the key width changes from the position D of the capstan screw 9*b* toward the rear end. In the present embodiment, the key width of the key assembly 100*b* changes discontinuously between the position E of the first hole part 22*b* (the second position) and the position D of the capstan screw 9*b*, and between the position D and the rear end C of the capstan screw 9*b*, respectively.

The central axis in the rear end C is misaligned from the central axis at the position D of the capstan screw 9*b* of the key assembly 100*b*. The central axis at the position D is misaligned from the central axis at the position E of the first hole part 22*b* (the second position) of the capstan screw 9*b*. That is, the center of gravity of the key assembly 100*b* is shifted in the scale directions between the rear end C, the position D of the capstan screw 9*b*, and the position E of the first hole part 22*b* (the second position), respectively.

As described above, according to the key assembly 100*b* of the present embodiment, since the minimum distance C1*b* of the rear end C is larger than the minimum distance D1*b* of the position D of the capstan screw 9*b*, and the minimum distance D1*b* of the position D of the capstan screw 9*b* is larger than the minimum distance E1*b* of the position E of the first hole portion 22*b* of the adjacent key assemblies 100*b* in each of the rotation ranges, the effect of the adjacent key assembly 100*b* due to the environmental changes and aging and the effect of lateral movement or twisting of key due to the key pressing operation during performance can be suppressed. The rigidity of the key 2*b* can be maintained by reducing the maximum width C2*b* of the rear end C and the maximum width D2*b* of the position D of the capstan screw 9*b* without changing the maximum width E2*b* of the position E of the first hole part 22*b* (the second position) of the key assembly 100*b*. Therefore, the keyboard apparatus according to the present embodiment can maintain reliability.

Fourth Embodiment

In the fourth embodiment, a key assembly 100*c* having a configuration different from that of the key assembly 100*b* in the third embodiment will be described. The fourth embodiment is different from the third embodiment in that the central axis in the rear end C of key assembly 100*c*, the central axis in the position D of the capstan screw 9*c*, and the central axis in the position E of the first hole part 22*c* (the second position) are almost coincide with each other. The parts that are the same as those of the first embodiment to the third embodiment are given the same numerals as those of the previous description, and a repetition of descriptions is omitted.

[Configuration of the Key Assembly]

Figure 14:
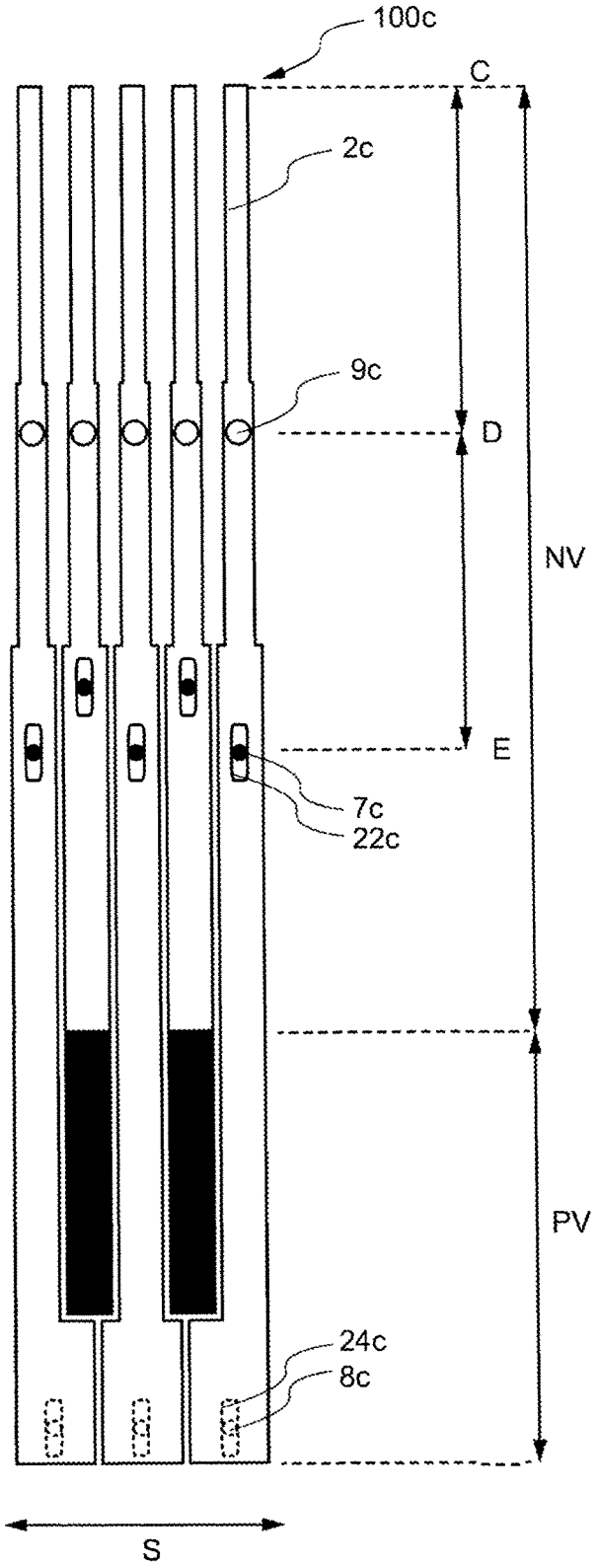
FIG. 14 is a top view showing a key assembly of a keyboard apparatus in one embodiment of the present disclosure.

The configuration of the key assembly will be described in detail with reference to FIG. 14. FIG. 14 is a top view showing the key assembly of the keyboard apparatus according to an embodiment of the present disclosure.

In this embodiment, the minimum distance C1*c* of the rear end C is larger than the minimum distance D1*c* of the position D of capstan screw 9*c* of the adjacent key assembly 100*c* in each rotation range. The minimum distance D1*c* of the position D of the capstan screw 9*c* is larger than the minimum distance E1*c* of the position E of the first hole part 22*c* (the second position) of the adjacent key assembly 100*c* in each rotation range.

The maximum width C2*c* of the rear end C is smaller than the maximum width D2*c* of the position D of the capstan screw 9*c* of the key assembly 100*c*. The maximum width D2*c* of the position D of the capstan screw 9*c* is smaller than the maximum width E2*c* of the position E of the first hole part 22*c* (the second position) of the key assembly 100*c*. In other words, the key widths of the key assembly 100*c* changes from the position E of the first hole part 22*c* (the second position) toward the rear end, and the key width changes from the position D of the capstan screw 9*c* toward the rear end. In the present embodiment, the key width of the key assembly 100*c* changes discontinuously between the position E of the first hole part 22*c* (the second position) and the position D of the capstan screw 9*c*, and between the position D and the rear end C of the capstan screw 9*c*, respectively.

The central axis in the rear end C, the central axis at the position D of the capstan screw 9*c*, and the central axis at the position E of the first hole part 22*c* (the second position) of the key assembly 100*c* are approximately coincide. That is, in the key assembly 100*c*, the rear end C, the position D of the capstan screw 9*c*, and the position E of the first hole part 22*c* (the second position) almost coincide with each other in the scale directions.

As described above, according to the key assembly 100*c* of the present embodiment, since the minimum distance C1*c* of the rear end C is larger than the minimum distance D1*c* of the position D of the capstan screw 9*c*, and the minimum distance D1*c* of the position D of the capstan screw 9*c* is larger than the minimum distance E1*c* of the position E1*c* of the first hole portion 22*c* of the adjacent key assemblies 100*c* in the respective rotation ranges, the effect of the adjacent key assembly 100*c* due to the environmental changes and aging and the effect of lateral movement or twisting of key due to the key pressing operation during performance can be suppressed. The rigidity of the key 2*c* can be maintained by reducing the maximum width C2*c* of the rear end C and the maximum width D2*c* of the position D of the capstan screw 9*c* without changing the maximum width E2*c* of the position E of the first hole part 22*c* (the second position) of the key assembly 100*c*. Therefore, the keyboard apparatus according to the present embodiment can maintain reliability.

Fifth Embodiment

The fifth embodiment is different from the fourth embodiment in that the key assembly 100*c* in the fourth embodiment and a key assembly 100*d* are alternately arranged. In the key assembly 100*d*, the maximum width C2*d* of the rear end C, the maximum width D2*d* of the position D of the capstan screw 9*d*, and the maximum width E2*d* of the position E of the first hole part 22*d* (the second position) are almost the same. The parts that are the same as those of the first embodiment to the fourth embodiment are given the same numerals as those of the previous description, and a repetition of descriptions is omitted.

[Configuration of the Key Assembly]

Figure 15:
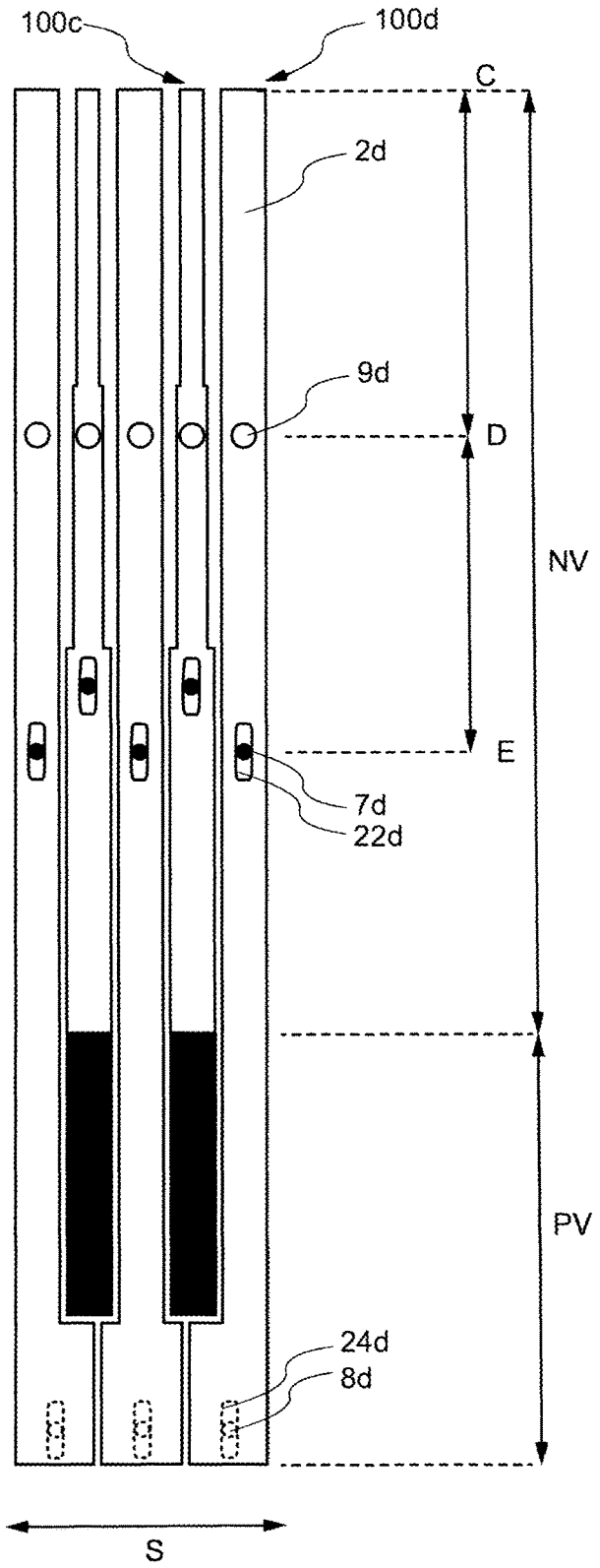
FIG. 15 is a top view showing a key assembly of a keyboard apparatus in one embodiment of the present disclosure.

The configuration of the key assembly will be described in detail with reference to FIG. 15. FIG. 15 is a top view showing the key assembly of the keyboard apparatus according to an embodiment of the present disclosure.

The maximum width C2*d* of the rear end C, the maximum width D2*d* of the position D of the capstan screw 9*d*, and the maximum width E2*d* of the position E of the first hole portion 22*d* of the key assembly 100*d* are almost the same. The key assembly 100*c* and key assembly 100*d* are alternately arranged.

In this embodiment, the minimum distance C1 of the rear end C is larger than the minimum distance D1 of position D of capstan screw 9*d* of the adjacent key assembly 100*c* and the key assembly 100*d* in each rotation range. The minimum distance D1 of the position D of capstan screw 9*d* is larger than the minimum distance E1 of the position E of the first hole part 22*d* (the second position) of the adjacent key assembly 100*c* and the key assembly 100*d* in each rotation range.

As described above, according to the configuration in which the key assembly 100*c* and the key assembly 100*d* are alternately arranged, since the minimum distance C1 of the rear end C is larger than the minimum distance D1 of the position D of the capstan screw 9*d*, and the minimum distance D1 of the position D of the capstan screw 9*d* is larger than the minimum distance E1 of the position E of the first hole portion 22*d* (the second position) of the adjacent key assembly 100*c* and key assembly 100*d* in the respective rotation ranges, the effect of the adjacent key assembly 100*c* and key assembly 100*d* due to the environmental changes and aging and the effect of lateral movement or twisting of key due to the key pressing operation during performance can be suppressed. Therefore, the keyboard apparatus according to the present embodiment can maintain reliability.

Sixth Embodiment

In the sixth embodiment, a key assembly 100*e* having a configuration differing from that of the key assembly 100*a* in the second embodiment will be described. The sixth embodiment is different from the key assembly 100*a* of the second embodiment in that the key assembly 100*e* is partially bent. The parts that are the same as those of the first embodiment to the fifth embodiments are given the same numerals as those of the previous description, and a repetition of descriptions is omitted.

[Configuration of the Key Assembly]

Figure 16:
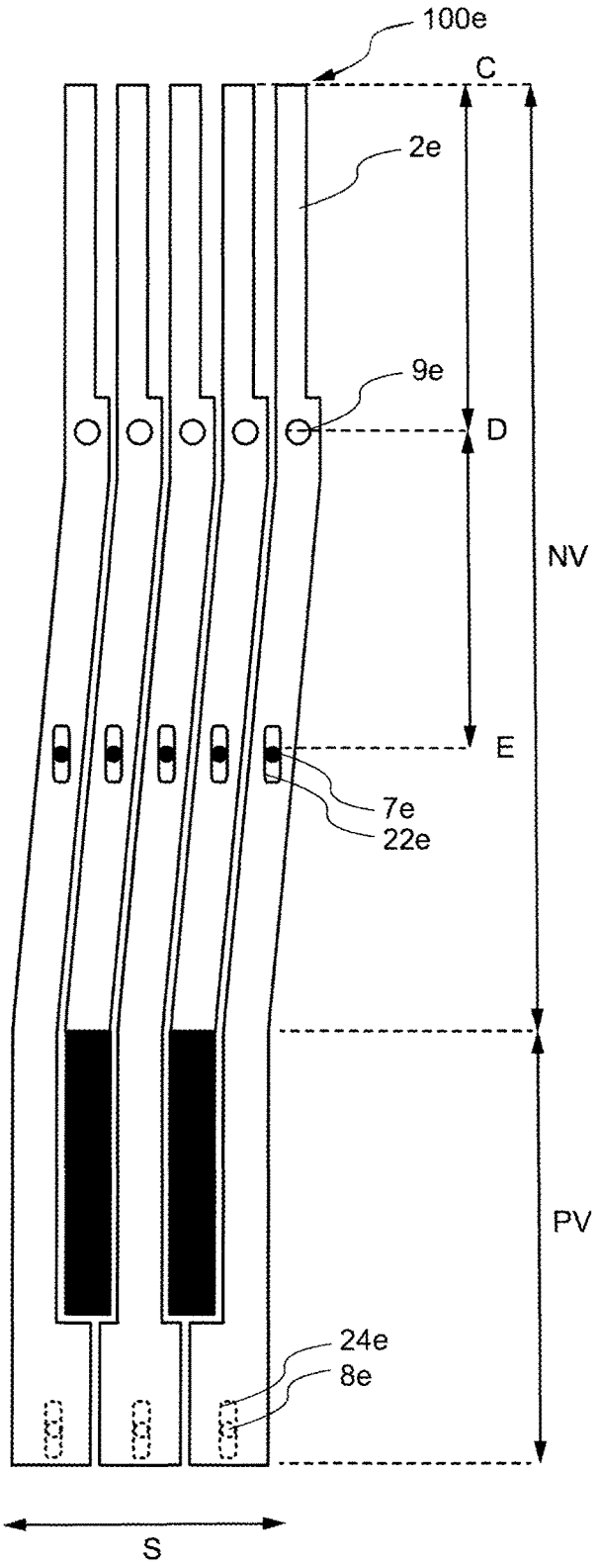
FIG. 16 is a top view showing a key assembly of a keyboard apparatus in one embodiment of the present disclosure.

The configuration of the key assembly will be described in detail with reference to FIG. 16. FIG. 16 is a top view showing the key assembly of the keyboard apparatus according to an embodiment of the present disclosure.

In the present embodiment, the key assembly 100*e* is partially bent. The axis of the key assembly 100*e* in the visible part PV and the axis of the key assembly 100*e* at least in the region from the position D of the capstan screw 9*e* to the rear end C are parallel. However, the present disclosure is not limited thereto, and the axis of the key assembly 100*e* in the visible part PV and the axis of the key assembly 100*e* in the region from the position D of the capstan screw 9*e* to the rear end C may not be parallel to each other.

In this embodiment, the minimum distance C1*e* of the rear end C is larger than the minimum distance E1*e* of the position E of the first hole part 22*e* (the second position) of the adjacent key assembly 100*e* in each rotation range. The minimum distance C1*e* of the rear end C is larger than the minimum distance D1*e* of the position D of the capstan screw 9*e* of the adjacent key assembly 100*e* in each rotation range.

The maximum width C2*e* of the rear end C is smaller than the maximum width E2*e* of the position E of the first hole part 22*e* (the second position) of the key assembly 100*e*. The maximum width C2*e* of the rear end C is smaller than the maximum width D2*e* of the position D of the capstan screw 9*e* of the key assembly 100*e*. In other words, the key widths of the key assembly 100*e* changes from the position D of the capstan screw 9*e* toward the rear end. In the present embodiment, the key width of the key assembly 100*e* changes to discontinuously between the position D of the capstan screw 9*e* and the rear end C.

In other words, the key width of the key assembly 100*e* according to the present embodiment changes in the region including the rear end C that is parallel to the axis of the key assembly 100*e* in the visible part PV. The key assembly 100*e* has the smallest maximum width C2*e* of the rear end C in the region that is parallel to the axis of the key assembly 100*e* in the visible part PV. Thus the minimum distance between the adjacent key assembly 100*e* varies in the region including the rear end C, that is parallel to the axis of the key assembly 100*e* in the visible part PV. The minimum distance C1*e* of the rear end C is the largest minimum distance of the adjacent key assembly 100*e* in the region that is parallel to the axis of the key assembly 100*e* in the visible part PV.

As described above, according to the key assembly 100*e* of the present embodiment, since the minimum distance C1*e* of the rear end C is larger than the minimum distance D1*e* of the position D of the capstan screw 9*e* of the adjacent key assembly 100*e* in each rotation range, the effect of the adjacent key assembly 100*e* due to the environmental changes and aging and the effect of lateral movement or twisting of key due to the key pressing operation during performance can be suppressed. The rigidity of the key 2*e* can be maintained by reducing the maximum width C2*e* of the rear end C without changing the maximum width E2*e* of the position E of the first hole part 22*e* (the second position) and the maximum width D2*e* of the position D of the capstan screw 9*e* of the key assembly 100*e*. Therefore, the keyboard apparatus according to the present embodiment can maintain reliability.

Seventh Embodiment

In a key assembly 100*f* of the seventh embodiment, the maximum width C2*f* of the rear end C, the maximum width D2*f* of the position D of the capstan screw 9*f*, and the maximum width E2*f* of the position E of the first hole portion 22*f* are almost the same. In the seventh embodiment, the minimum distance C1*f* of the rear end C is larger than the minimum distance E1*f* of the position E of the first hole part 22*f* (the second position) of the adjacent key assembly 100*f* in each rotation range. The parts that are the same as those of the first embodiment to the sixth embodiment are given the same numerals as those of the previous description, and a repetition of descriptions is omitted.

[Configuration of the Key Assembly]

Figure 17:
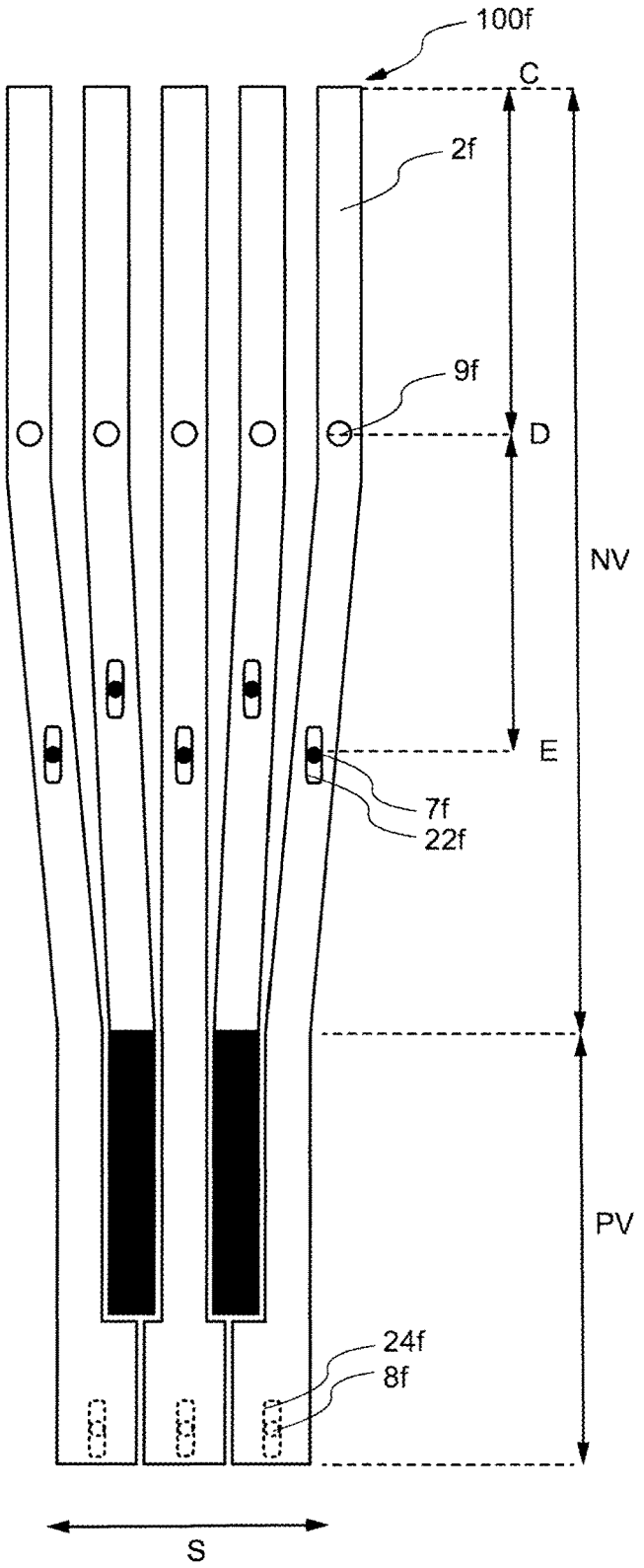
FIG. 17 is a top view showing a key assembly of a keyboard apparatus in one embodiment of the present disclosure.

The configuration of the key assembly will be described in detail with reference to FIG. 17. FIG. 17 is a top view showing the key assembly of the keyboard apparatus according to an embodiment of the present disclosure.

In the present embodiment, the key assembly 100*f* is partially bent. The axis of the key assembly 100*f* in the visible part PV and the axis of the key assembly 100*f* in the region from at least the position D of the capstan screw 9*f* to the rear end C are parallel. The maximum width C2*f* of the rear end C, the maximum width D2*f* of the position D of the capstan screw 9*f*, and the maximum width E2*f* of the position E of the first hole portion 22*f* of the key assembly 100*f* are almost the same. In other words, the key width of the key assembly 100*f* does not change from the position E of the first hole part 22*f* (the second position) toward the rear end.

In this embodiment, the minimum distance C1*f* of the rear end C is larger than the minimum distance E1*f* of the position E of the first hole part 22*f* (the second position) of the adjacent key assembly 100*f* in each rotation range. The minimum distance D1*f* of the position D of the capstan screw 9*f* is larger than the minimum distance E1*f* of the position E of the first hole part 22*f* (the second position) of the adjacent key assembly 100*f* in each rotation range.

As described above, according to the key assembly 100*f* of the present embodiment, since the minimum distance C1*f* of the rear end C and the minimum distance D1*f* of the capstan screw 9*f* are larger than the minimum distance E1*f* of the position E of the first hole portion 22*f* (the second position) of the adjacent key assemblies 100*f* in the respective rotation ranges, the effect of the adjacent key assembly 100*f* due to the environmental changes and aging and the effect of lateral movement or twisting of key due to the key pressing operation during performance can be suppressed. Without changing the maximum width E2*f* of the position E of the first hole part 22*f*, the maximum width D2*f* of the position D of the capstan screw 9*f*, and the maximum width C2*f* of the rear end C of the key assembly 100*f*, the minimum distance C1*f* of the rear end C and the minimum distance D1*f* of the capstan screw 9*f* of the adjacent key assembly 100*f* in the respective rotation ranges can be increased, and the rigidity of the key 2*f* can be maintained. Therefore, the keyboard apparatus according to the present embodiment can maintain reliability.

Modified Example 1

Figure 18:
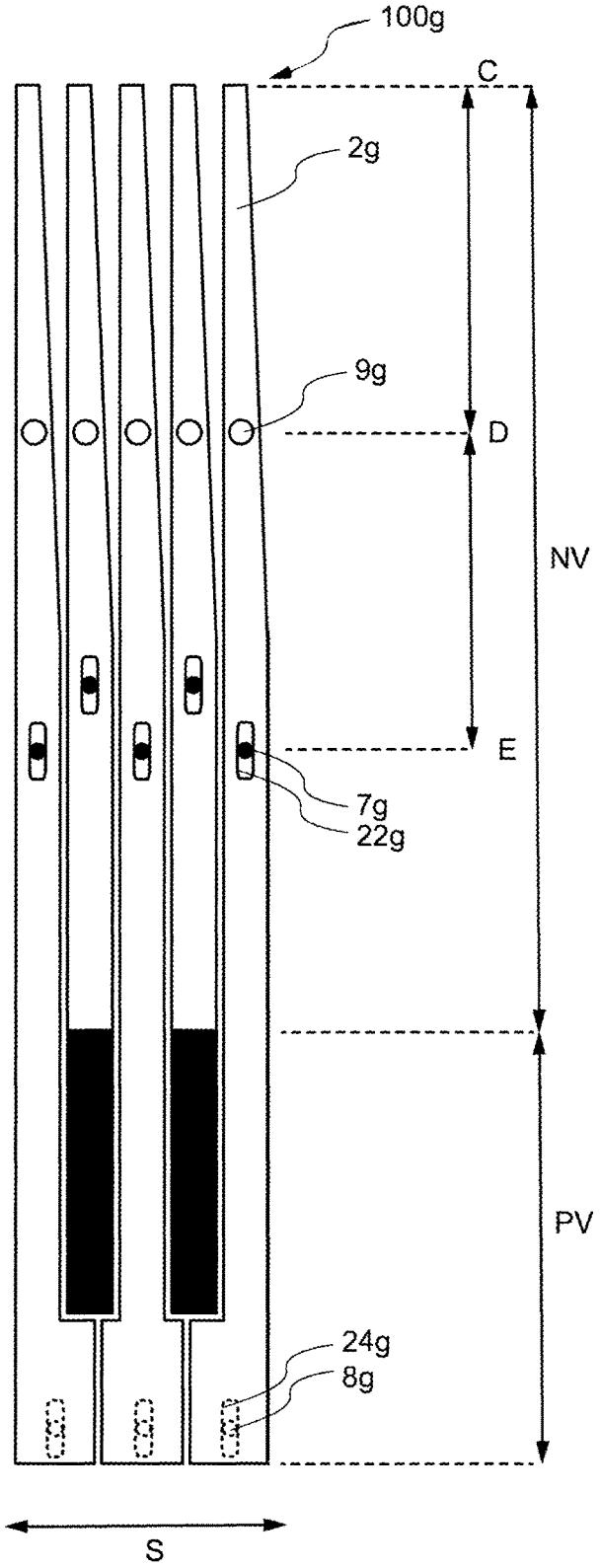
FIG. 18 is a top view showing a key assembly of a keyboard apparatus in a variation of the present disclosure.

In the modified example 1, a modified example of a key assembly 100*b* in the third embodiment will be described. FIG. 18 is a top view showing a key assembly of a keyboard apparatus according to a modified example of the present disclosure.

The maximum width C2*g* of the rear end part C is smaller than the maximum width D2*g* of the position D of the capstan screw 9*g* of the key assembly 100*g*. The maximum width D2*g* of the position D of the capstan screw 9*g* is smaller than the maximum width E2*g* of the position E of the first hole part 22*g* (the second position) of the key assembly 100*g*. In other words, the key width of the key assembly 100*g* changes from the position E of the first hole part 22*g* (the second position) toward the rear end, and the key width of the key assembly 100*g* changes from the position D of the capstan screw 9*g* toward the rear end. In this modified example, the key width of the key assembly 100*g* continuously changes between the position E of the first hole part 22*g* (the second position) and the rear end C.

Modified Example 2

Figure 19:
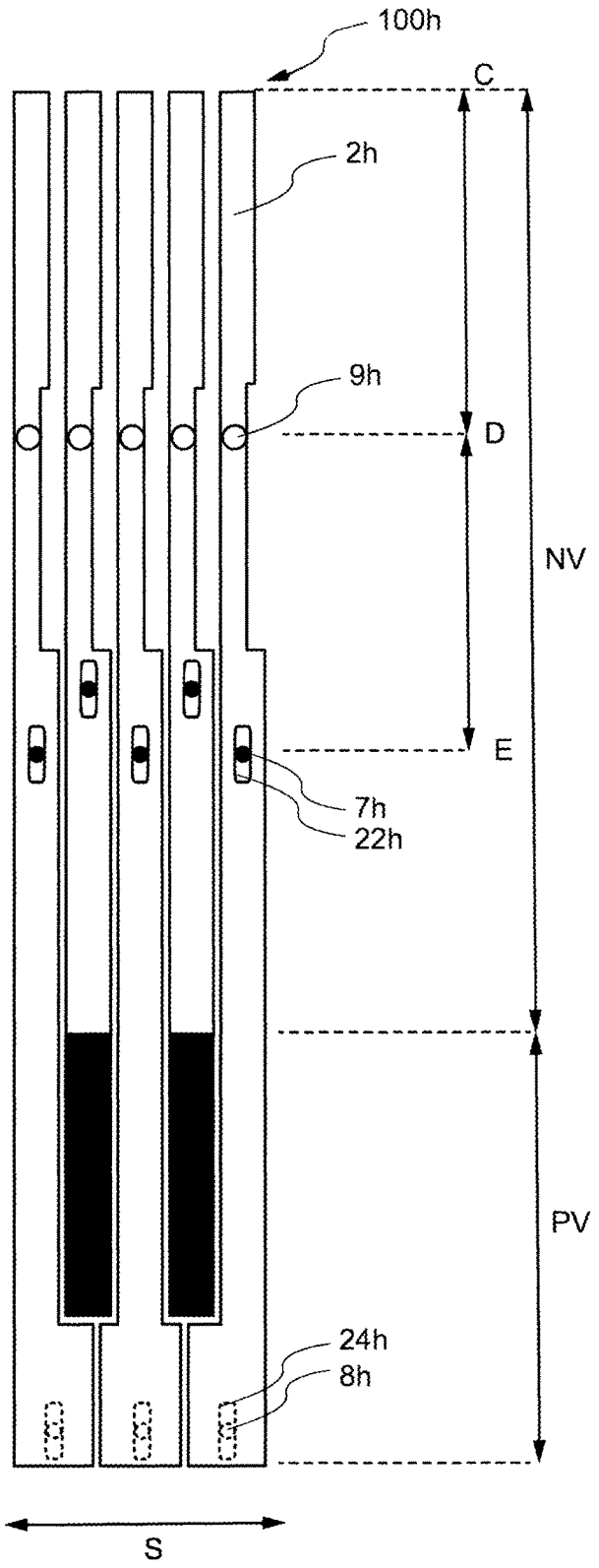
FIG. 19 is a top view showing a key assembly of a keyboard apparatus in a variation of the present disclosure.

In the modified example 2, a modified example of a key assembly 100 in the first embodiment will be described. FIG. 19 is a top view showing a key assembly of a keyboard apparatus according to a modified example of the present disclosure.

In this modified example, the maximum width C2*h* of the rear end C is smaller than the maximum width E2*h* of the position E of the first hole part 22*h* (the second position) of the key assembly 100*h*. The maximum width D2*h* of the position D of the capstan screw 9*h* may be smaller than the maximum width C2*h* of the rear end C and the maximum width E2*h* of the position E of the first hole portion 22*h* of the key assembly 100*h*.

Modified Example 3

In the present embodiment, the keyboard assembly of the ground piano is shown as an exemplary keyboard apparatus. However, the present disclosure is not limited thereto, and the present disclosure can be applied to a keyboard apparatus having a first position and a second position for regulating the movement in the scale direction S. An example of a keyboard apparatus may be an electronic piano, for example.

The embodiments and modified examples described above as the embodiments of the present disclosure can be appropriately combined and implemented as long as they do not contradict each other. It is also within the scope of the present disclosure to the extent that a person skilled in the art adds, deletes, or changes the designs of components as appropriate based on the key assembly of the embodiment, as long as the gist of the present disclosure is included.

What is claimed is:

1. A keyboard apparatus comprising:

a first key assembly including:

a first key arranged along a plane;

a first member disposed at a first position; and a second member disposed at a second position, which is positioned between a front end and a rear end of the first key, and a rear side of the first position, wherein the first key is slidably in contact with the first member and the second member, and rotatable about the second member;

a second key assembly including:

a second key arranged next to the first key along the plane;

a third member disposed at a third position; and a fourth member disposed at a fourth position, which is positioned between a front end and a rear end of the second key, and a rear side of the third position, wherein the second key is slidably in contact with the third member and the fourth member, and rotatable about the fourth member, and wherein a first minimum distance between the first key and the second key at the rear ends thereof being larger than a second minimum distance between the first key and the second key at the second position within a range of rotation of the first key; and a third key assembly including:

a third key arranged next to the first key along the plane on a side opposite to the second key;

a fifth member disposed at a fifth position; and a sixth member disposed at a sixth position, which is positioned between a front end and a rear end of the third key, and a rear side of the fifth position, wherein the third key is slidably in contact with the fifth member and the sixth member, and rotatable about the sixth member, and wherein a third minimum distance between the first key and the third key at the rear ends thereof being larger than a fourth minimum distance between the first key and the third key at the second position within a range of rotation of the first third key.

2. The keyboard apparatus according to claim 1, wherein:

the first key includes a seventh position, which is positioned at the rear side of the second position, for receiving a load applied to the first key, the second key includes an eighth position, which is positioned at the rear side of the fourth position, for receiving a load applied to the second key, the first minimum distance is larger than a fifth minimum distance between the first key and the second key at the seventh position within the range of rotation of the first key, the third key includes a ninth position, which is positioned at the rear side of the sixth position, for receiving a load applied to the third key, and the third minimum distance is larger than a sixth minimum distance between the first key and the third key at the seventh position within the range of rotation of the first key.

3. The keyboard apparatus according to claim 1, wherein:

the first key assembly includes a first capstan positioned at the rear side of the second position, the second key assembly includes a second capstan positioned at the rear side of the fourth position, the first minimum distance is larger than a fifth minimum distance between the first key and the second key at the first capstan within the range of rotation of the first key, the third key assembly includes a third capstan positioned at the rear side of the sixth position, and the third minimum distance is larger than a sixth minimum distance between the first key assembly and the third key assembly at the first capstan, within the range of rotation of the first key.

4. The keyboard apparatus according to claim 3, wherein:

the fifth minimum distance is larger than the second minimum distance, and the sixth minimum distance is larger than the fourth minimum distance.

5. The keyboard apparatus according to claim 3, wherein a first width of the first key at the rear end of the first key is smaller than a second width of the first key at the second position of the first key.

6. The keyboard apparatus according to claim 3, wherein a first width of the first key at the rear end of the first key is smaller than a second width of the first key at the first capstan.

7. The keyboard apparatus according to claim 4, wherein a first width of the first key at the first capstan is smaller than a second width of the first key at the second position.

8. The keyboard apparatus according to claim 5, wherein a width of the first key changes discontinuously at the rear side of the second position.

9. The keyboard apparatus according to claim 6, wherein a width of the first key changes discontinuously at the rear side of the first capstan.

10. The keyboard apparatus according to claim 7, wherein a width of the first key changes discontinuously between the second position and the first capstan.

11. The keyboard apparatus according to claim 3, wherein a central axis of the rear end of the first key and a central axis of the second position of the first key are not aligned with each other in a direction perpendicular to the plane.

12. The keyboard apparatus according to claim 11, wherein the central axis of the rear end of the first key and a central axis of the first capstan are not aligned with each other in the direction perpendicular to the plane.

13. The keyboard apparatus according to claim 12, wherein the central axis of the first capstan and the central axis of the first key at the second position are not aligned with each other in the direction perpendicular to the plane.

14. The keyboard apparatus according to claim 1, further comprising:

a key bed, wherein the second member comprises a first balance pin protruding in the direction substantially perpendicular to the key bed, the fourth member comprises a second balance pin protruding in the direction substantially perpendicular to the key bed, and the sixth member comprises a third balance pin protruding in the direction substantially perpendicular to the key bed.

15. The keyboard apparatus according to claim 1, further comprising:

a key bed, wherein the first member comprises a first front pin protruding in the direction substantially perpendicular to the key bed, the third member comprises a second front pin protruding in the direction substantially perpendicular to the key bed, and the fifth member comprises a third front pin protruding in the direction substantially perpendicular to the key bed.

16. A keyboard apparatus comprising:

a key assembly including:

a key arranged along a plane and being slidably in contact with a first member along the plane at a first position of the key and a second member along the plane at a second position, which is positioned on a rear side of the first position, of the key; and a capstan positioned at a rear side of the key at the second position, wherein a first width of the key at the rear end of the key is smaller than a second width of the key at the capstan.

17. The keyboard apparatus according to claim 16, wherein the second width is smaller than a third width of the key at the second position.

* * * * *